US009014399B2

(12) United States Patent
Jasa et al.

(10) Patent No.: US 9,014,399 B2
(45) Date of Patent: Apr. 21, 2015

(54) ECM DIGITAL MICROPHONE TEMPERATURE COMPENSATION

(75) Inventors: Hrvoje Jasa, Scarborough, ME (US); Andrew M. Jordan, Scarborough, ME (US)

(73) Assignee: Fairchild Semiconductor Corporation, San Jose, CA (US)

( * ) Notice: Subject to any disclaimer, the term of this patent is extended or adjusted under 35 U.S.C. 154(b) by 693 days.

(21) Appl. No.: 13/416,495

(22) Filed: Mar. 9, 2012

(65) Prior Publication Data

US 2012/0230500 A1 Sep. 13, 2012

Related U.S. Application Data

(60) Provisional application No. 61/451,711, filed on Mar. 11, 2011.

(51) Int. Cl.

| | |
|---|---|
| ***H04R 3/00*** | (2006.01) |
| ***H04R 19/01*** | (2006.01) |
| ***H04R 29/00*** | (2006.01) |

(52) U.S. Cl.

CPC ..... *H04R 19/016* (2013.01); *H04R 29/004* (2013.01)

(58) Field of Classification Search

CPC ..... H03G 11/00; H04R 19/01; H04R 19/04; H04R 19/016; H04R 29/04; H04R 29/004

USPC ..... 381/55, 95, 111, 112, 113, 114, 115, 381/122, 174

See application file for complete search history.

(56) References Cited

U.S. PATENT DOCUMENTS

| | | | | |
|---|---|---|---|---|
| 8,855,335 | B2 * | 10/2014 | Henriksen | 381/120 |
| 2011/0015893 | A1 | 1/2011 | Altman et al. | |
| 2011/0200212 | A1 * | 8/2011 | Wismar | 381/174 |
| 2011/0311080 | A1 * | 12/2011 | Jaar et al. | 381/174 |

FOREIGN PATENT DOCUMENTS

| | | | |
|---|---|---|---|
| CN | 1771758 | A | 5/2006 |
| CN | 102695113 | A | 9/2012 |
| CN | 202750047 | U | 2/2013 |

OTHER PUBLICATIONS

"Chinese Application Serial No. 201220109933.0, Voluntary Amendments filed Mar. 26, 2012", English Translation Only, 15 pgs.
"Chinese Application Serial No. 201210078941.8, Office Action mailed Feb. 26, 2014", 7 pgs.
"Chinese Application Serial No. 201220109933.0, Notification to Make Rectification mailed Aug. 2, 2012", 19 pgs.
"Chinese Application Serial No. 201220109933.0, Response filed Oct. 12, 2012 to Office Action mailed Aug. 2, 2012", 7 pgs.
"Chinese Application Serial No. 201210078941.8 Response filed Nov. 17, 2014 to Non Final Office Action mailed Oct. 17, 2014", With English translation., 3 pages.

(Continued)

*Primary Examiner* — Vivian Chin
*Assistant Examiner* — Friedrich W Fahnert
(74) *Attorney, Agent, or Firm* — Schwegman Lundberg & Woessner, P.A.

(57) ABSTRACT

This document discusses, among other things, systems and methods to at least partially compensate for temperature sensitivity in a digital microphone system including, for example, a temperature sensitive membrane, such as an electrets condenser microphone (ECM).

21 Claims, 3 Drawing Sheets

(56) References Cited

OTHER PUBLICATIONS

"Chinese Application Serial No. 201210078941.8, Office Action mailed Oct. 17, 2014", w/English Translation, 2 pgs.

"Chinese Application Serial No. 201210078941.8, Response filed Sep. 10, 2014 to Office Action mailed Feb. 26, 2014", 13 pgs.

"Chinese Application Serial No. 201210078941.8, Response filed Nov. 25, 2014", 6 pgs.

* cited by examiner

ECM DIGITAL MICROPHONE TEMPERATURE COMPENSATION

CLAIM OF PRIORITY

This application claims the benefit of priority under 35 U.S.C. §119(e) of Jasa et al. U.S. Provisional Patent Application Ser. No. 61/451,711, entitled "ECM DIGITAL MICROPHONE TEMPERATURE COMPENSATION," filed on Mar. 11, 2011, which is incorporated by reference herein in its entirety.

BACKGROUND

An electret is a dielectric material having a quasi-permanent electric charge or dipole polarization. Electret materials are quite common in nature. For example, quartz and other forms of silicon dioxide are naturally occurring electrets. However, many electrets are synthetic, prepared by heating a dielectric above its melting temperature and then cooling the melted dielectric in a strong electric field.

In certain examples, electret material can be used as a membrane for a microphone. An electret condenser microphone (ECM), for example, eliminates the need for a polarizing power supply in a digital microphone system by providing a permanently charged or polarized material. However, ECMs can be sensitive to temperature.

OVERVIEW

This document discusses, among other things, systems and methods to at least partially compensate for temperature sensitivity in a digital microphone system including, for example, a temperature sensitive membrane, such as an electret condenser microphone (ECM).

In an example, a system can include a temperature independent voltage reference and a temperature compensation circuit, the temperature compensation circuit including a temperature dependent component configured to provide a first reference with respect to the temperature independent voltage reference and a voltage divider configured to provide second and third references with respect to the temperature independent voltage reference. In an example, the temperature compensation circuit can be configured to provide a voltage reference configured to at least partially compensate for a temperature sensitivity of a digital microphone system using the third reference and the difference between the first and second references.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present inventors have recognized, among other things, a system and method configured to compensate for electret membrane sensitivity (dBV/Pa) to temperature in a digital microphone system. Electret membranes can have various temperature coefficients resulting from, for example, different manufacturers or manufacturing processes. Temperature variance can adversely affect a digital microphone system, including providing sensitivity imbalance or a varying dynamic gain. In an example, the sensitivity of a digital microphone system can be adjusted with respect to temperature to effectively null the temperature variance, allowing digital microphone manufacturers to make and sell devices with zero gain or near-zero gain temperature sensitivity.

For example, digital microphone systems including one or more digital microphones can be used for, among other things, noise cancellation in mobile device applications. In an example, each of the one or more digital microphones can be subjected to different temperatures, depending on the location of the one or more digital microphones on the mobile device, such as their proximity to a charging circuit, a transmission circuit, or other portion of the mobile device generating heat. In noise cancellation applications, sensitivity variance in one or more digital microphones can greatly affect cancellation of the detected noise. Accordingly, one or more temperature compensation circuits can be used to at least partially compensate for temperature sensitivity in the digital microphone system.

Figure 1:
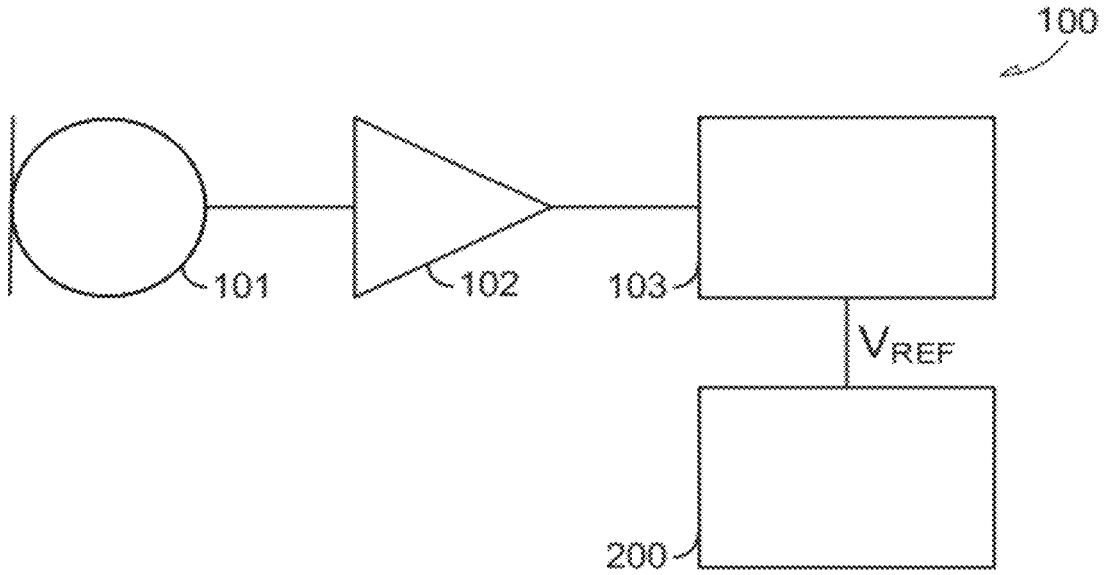
FIG. 1 illustrates generally an example digital microphone system including a temperature compensation circuit.

FIG. 1 illustrates generally an example digital microphone system 100 including a temperature compensation circuit 200, a microphone 101, a pre-amplifier 102, and an analog-to-digital converter (ADC) 103.

In an example, the microphone 101 can include a microphone having a temperature sensitive membrane, such as an electret membrane or other temperature sensitive membrane. In an example, the microphone 101 can include an electret condenser microphone (ECM), or one or more other digital microphones having a non-zero temperature coefficient.

In an example, the pre-amplifier 102 can include an audio amplifier or one or more other amplifiers configured to receive information from the microphone 101 (e.g., audio output, etc.) and to provide information (e.g., an amplified audio signal, etc.) to the ADC 103. In an example, the temperature compensation circuit 200 can be configured to provide a reference voltage ($V_{REF}$) to the ADC 103 to at least partially compensate for the temperature sensitivity of the microphone 101, or one or more other components of the digital microphone system 100, for example, to control an effective gain of the digital microphone system 100 with respect to temperature. In an example, the ADC 103 can be configured to provide a digital microphone signal to one or more components, such as a noise cancellation circuit, an audio processor, a baseband processor, etc.

In an example, the gain of the digital microphone system 100 can be expressed as:

$$G_{system}\left(\frac{dBFS}{dBV_{RMS}}\right) = A_{pre}(dB) - V_{REF}(dBV) \quad \text{(Eq. 1)}$$

In certain examples, the gain of the pre-amplifier 102 ($A_{pre}$) can be fixed with little temperature variation. To provide a stable $V_{REF}$, a mixture of voltage and temperature can be used.

Figure 2:
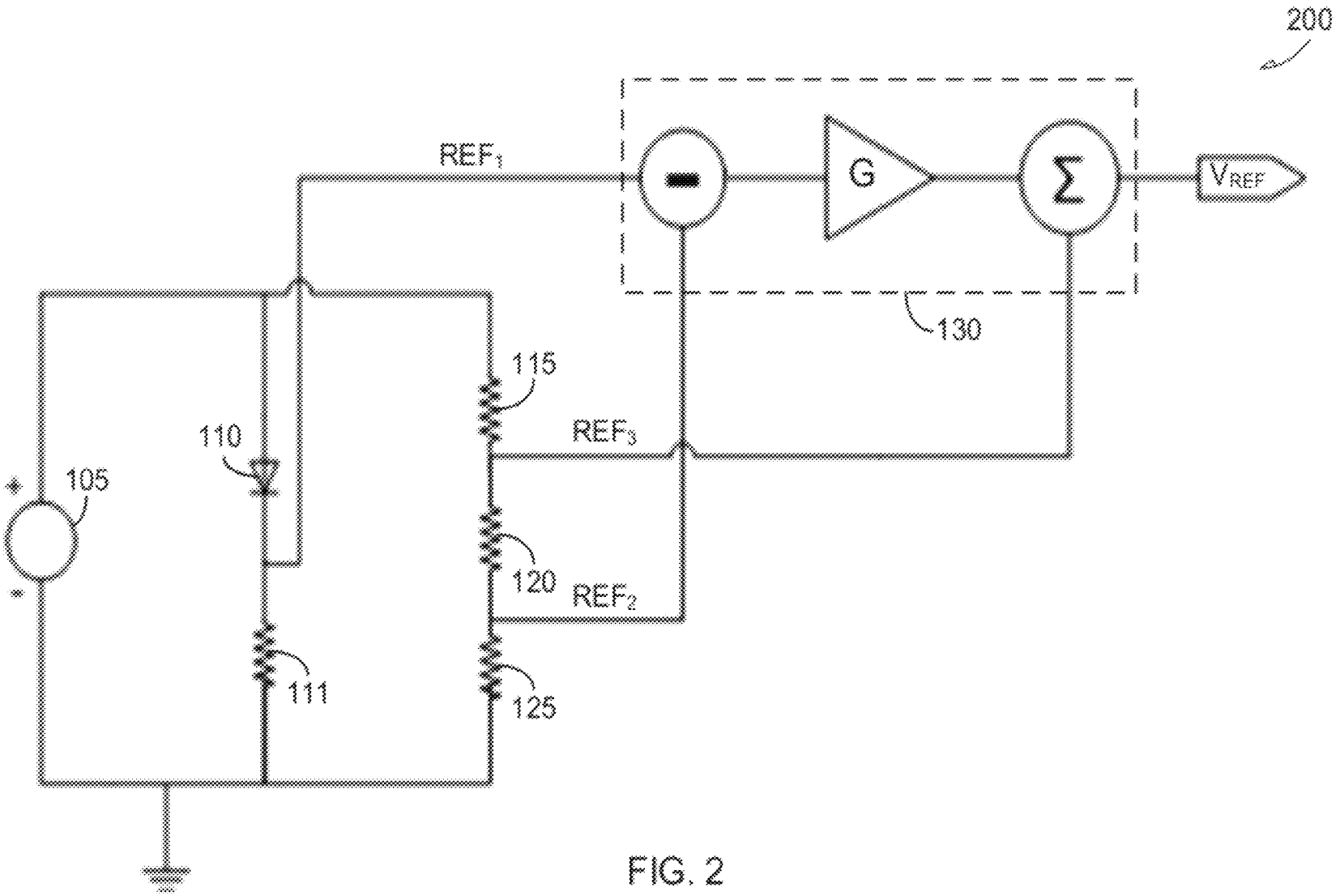
FIG. 2 illustrates generally an example temperature compensation circuit for a digital microphone system.

FIG. 2 illustrates generally an example temperature compensation circuit 200 for a digital microphone system. In an example, the temperature compensation circuit 200 can include a temperature independent voltage reference 105, a temperature dependent component 110 configured to provide a first reference ($REF_1$) with respect to the temperature independent voltage reference 105, and a voltage divider configured to provide second and third references ($REF_2$, $REF_3$, respectively) with respect to the temperature independent voltage reference 105.

In an example, the temperature independent voltage reference 105 can include a bandgap voltage ($V_{BG}$) or other voltage reference configured to provide a reference voltage ($V_{BG}$) that is stable with respect to temperature. In certain examples, the temperature independent voltage reference 105 can include, among other things, a diode, a resistor, or one or more other components.

The temperature dependent component 110 can include a diode or one or more other active or passive temperature dependent components configured to provide a voltage ($V_D$) that varies with respect to temperature. In an example, the diode can be coupled to ground through a resistor 111, and in certain examples, the diode and the resistor 111 can match the diode and the resistor of the temperature independent voltage reference 105.

In an example, the voltage divider circuit can include a resistor divider network including first, second, and third resistors 115, 120, 125 configured to provide $REF_2$ and $REF_3$ with respect to the temperature independent voltage reference 105. In other examples, the voltage divider circuit can include one or more other components configured to provide $REF_2$ and $REF_3$, such as capacitors, inductors, etc.

In an example, the temperature compensation circuit 200 can include an amplifier 130 (e.g., one or more amplifiers in various configurations) configured to provide a voltage reference ($V_{REF}$) configured to at least partially compensate for a temperature sensitivity of the digital microphone system using $REF_3$ and a difference between REF' and $REF_2$. In an example, the temperature compensation circuit 105 can include one or more analog or digital circuits configured to provide $V_{REF}$ as a function of a sum of (1) $REF_3$ and (2) a difference between $REF_1$ and $REF_2$. In an example, the amplifier 130 can be configured to amplify or attenuate (e.g., by a factor of G, etc.) one or more of $REF_1$, $REF_2$, or $REF_3$, the difference between the $REF_1$ and $REF_2$, or the sum of $REF_3$ and the difference between $REF_1$ and $REF_2$.

In an example, in an integrated circuit, a diode can exhibit a −2 mV/° C. change in forward voltage. Thus, in the temperature compensation circuit 200, $REF_1$ at temperature ($T_0$) (e.g., room temperature, or ~27° C.) can be expressed as:

$$V_{REF_1(T_0)}=V_{BG(T_0)}-V_{D(T_0)} \quad \text{(Eq. 2)}$$

Example $V_{BG(T_0)}$ and $V_{D(T_0)}$ values can include $$V_{BG(T_0)}=1.2\text{V} \quad \text{(Eq. 3)}$$

$$V_{D(T_0)}=0.7\text{V} \quad \text{(Eq. 4)}$$

Accordingly, $V_{REF_1(T_0)}$ can be expressed as:

$$V_{REF_1(T_0)}=0.5\text{V}+2\ \text{mV/° C.} \quad \text{(Eq. 5)}$$

In an example, the voltage of the temperature dependant component 110 can be obtained by subtracting ($V_{BG(T_0)}-V_{D(T_0)}$) from $V_{REF_1(T)}$. The value of $V_{D(T_0)}$ can be estimated using $V_{BG(T_0)}$, and the voltage at node $REF_2$ can be expressed as:

$$V_{REF_2(T_0)} = V_{BG(T_0)}\left(\frac{R_3}{R_1+R_2+R_3}\right) \cong V_{BG(T_0)} - V_{D(T_0)} \quad \text{(Eq. 6)}$$

Doing the subtraction of $V_{REF_1BG(T)}$ and $V_{REF_2BG(T)}$ gives us a voltage that has +2 mV/° C.

$$V_{REF_1(T)}-V_{REF_2(T)}=0+0.002(T-T_0) \quad \text{(Eq. 7)}$$

With any choice of value G, an arbitrary temperature coefficient can be created and added to any desired $V_{REF}$. Accordingly, using the examples illustrated herein, any value of $V_{REF}$ can be chosen. In certain examples, $V_{REF}$ can be less than $V_{BG}$ (however, this is not a limitation). In an example, the resultant $V_{REF}$ can be illustrated as:

$$V_{REF(T)} = V_{BG(T)}\left(\frac{R_2+R_3}{R_1+R_2+R_3}\right) + G(V_{REF_1(T)} - V_{REF_2(T)}) \quad \text{(Eq. 8)}$$

The only term in the equation that has a temperature dependence is $V_{D(T_0)}$. Subtracting out the baseline term allows operation of the temperature compensation circuit 200 under low power supply conditions, and also allows maximum flexibility to choose $V_{REF}$ because the voltage drop of the diode 110 is no longer a concern.

In an example, an integrated circuit can include the temperature compensation circuit 200. In an example, the temperature compensation circuit 200 can include the temperature independent voltage reference 105. In other examples, the temperature independent voltage reference 105 can be a component external to the temperature compensation circuit 200.

Figure 3:
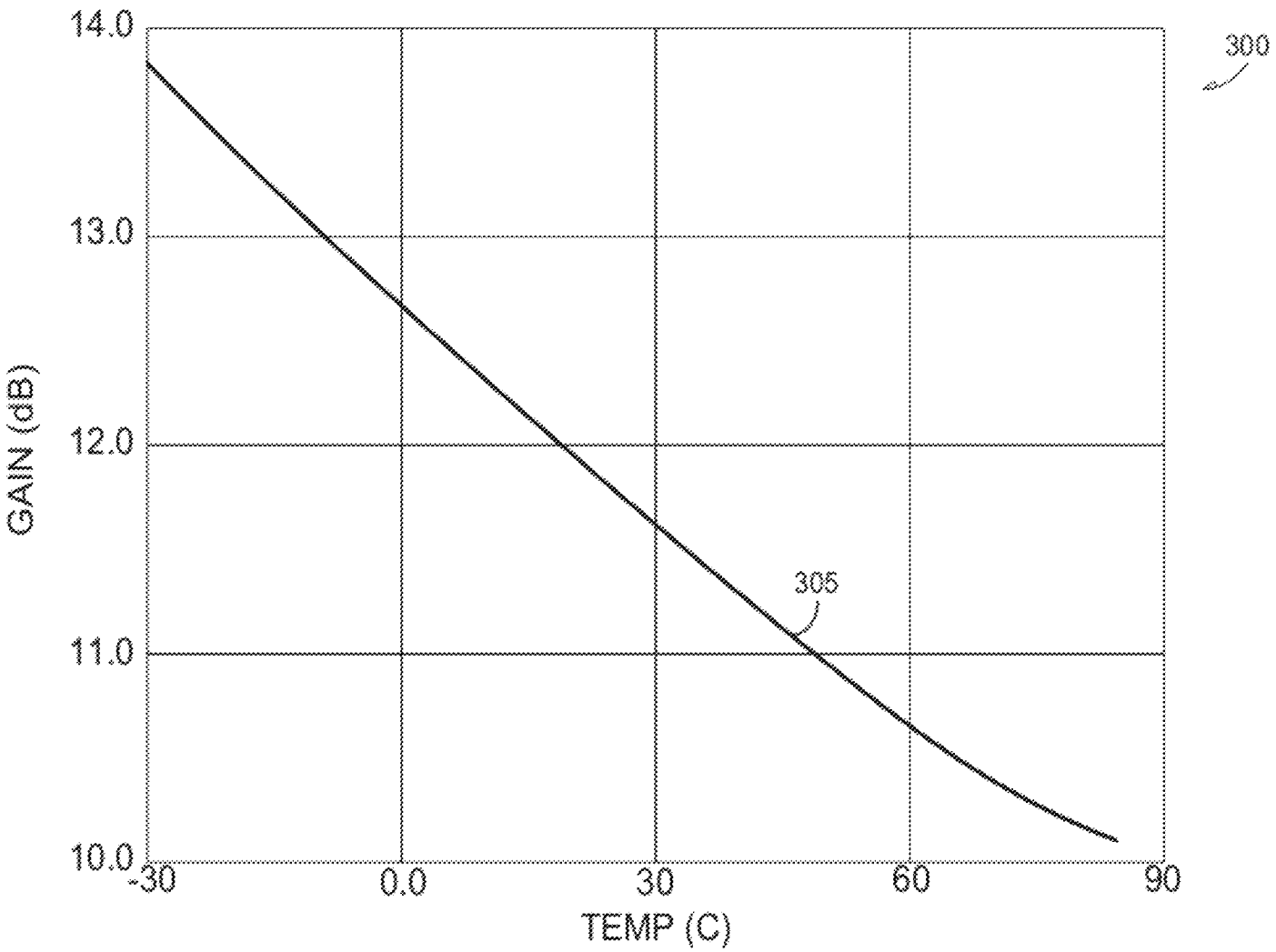
FIG. 3 illustrates generally an example of computer simulated gain correction in decibels (dB) with respect to temperature (° C.) for the temperature compensation circuit illustrated in the example of FIG. 1.

FIG. 3 illustrates generally an example of computer simulated gain correction 305 in decibels (dB) with respect to temperature (° C.) of the temperature compensation circuit 200 illustrated in the example of FIG. 2.

Additional Notes

In Example 1, a system includes a temperature independent voltage reference and a temperature compensation circuit for a digital microphone system. The temperature compensation circuit includes a temperature dependent component configured to provide a first reference with respect to the temperature independent voltage reference and a voltage divider configured to provide second and third references with respect to the temperature independent voltage reference, and the temperature compensation circuit is configured to provide a voltage reference configured to at least partially compensate for a temperature sensitivity of a digital microphone system using the third reference and a difference between the first and second references.

In Example 2, the temperature independent voltage reference of Example 1 optionally includes a bandgap voltage reference, and the bandgap voltage reference can include a diode.

In Example 3, the temperature dependent component of one or more of Examples 1-2 optionally includes a diode, wherein the diode of the temperature dependent component optionally matches the diode of the bandgap voltage reference.

In Example 4, the temperature dependent component of one or more of Examples 1-3 optionally includes a diode.

In Example 5, the digital microphone system of one or more of Examples 1-4 optionally includes a temperature sensitive membrane.

In Example 6, the digital microphone system of one or more of Examples 1-5 optionally includes an electret condenser microphone (ECM), the ECM including the temperature sensitive membrane.

In Example 7, one or more of Examples 1-6 optionally includes the ECM.

In Example 8, the digital microphone system of one or more of Examples 1-7 optionally includes an electret membrane having a temperature sensitivity, wherein the temperature compensation circuit is configured to at least partially compensate for the temperature sensitivity of the electret membrane.

In Example 9, one or more of Examples 1-8 optionally includes the digital microphone system, the digital microphone system including a microphone including a temperature sensitive membrane, a pre-amplifier configured to receive information from the microphone, and an analog-to-digital converter (ADC) configured to receive information from the pre-amplifier and to receive the reference voltage from the temperature compensation circuit.

In Example 10, the voltage divider of one or more of Examples 1-9 optionally includes a resistor divider network including first, second, and third resistors coupled in series, wherein the first, second, and third resistors have a common temperature coefficient.

In Example 11, one or more of Examples 1-10 optionally includes an amplifier configured to receive the first, second, and third references and to provide the voltage reference using a sum of (1) the third reference and (2) a difference between the first and second references.

In Example 12, a method includes providing a first reference, using a temperature dependent component, with respect to a temperature independent voltage reference, providing second and third references, using a voltage divider, with respect to the temperature independent voltage reference, providing a voltage reference using a temperature compensation circuit as a function of the third reference and a difference between the first and second references, and at least partially compensating for a temperature sensitivity of a digital microphone system using the voltage reference.

In Example 13, one or more of Examples 1-12 optionally includes providing the temperature independent voltage reference using a bandgap voltage reference, the bandgap voltage reference including a diode.

In Example 14, the temperature dependent component of one or more of Examples 1-13 optionally includes a diode, wherein the diode of the temperature dependent component matches the diode of the bandgap voltage reference.

In Example 15, the temperature dependent component of one or more of Examples 1-14 optionally includes a diode.

In Example 16, the digital microphone system of one or more of Examples 1-15 optionally includes a temperature sensitive membrane.

In Example 17, the digital microphone system of one or more of Examples 1-16 optionally includes an electret condenser microphone (ECM), the ECM including the temperature sensitive membrane.

In Example 18, the digital microphone system of one or more of Examples 1-17 optionally includes an electret membrane having a temperature sensitivity, wherein the at least partially compensating for the temperature sensitivity includes at least partially compensating for the temperature sensitivity of the electret membrane.

In Example 19, the voltage divider of one or more of Examples 1-18 optionally includes a resistor divider network including first, second, and third resistors coupled in series, the first, second, and third resistors have a common temperature coefficient.

In Example 20, the providing the voltage reference of one or more of Examples 1-19 optionally includes using an amplifier configured to receive the first, second, and third references and to provide the voltage reference using a sum of (1) the third reference and a difference between the first and second references.

In Example 21, a system includes a bandgap voltage reference, including a diode, and a temperature compensation circuit for a digital microphone system including an electret condenser microphone (ECM). The temperature compensation circuit includes a diode configured to provide a first reference with respect to the bandgap voltage reference, wherein the diode of the bandgap voltage reference matches the diode of the temperature compensation circuit, and a resistor divider network including first, second, and third resistors coupled in series, the resistor divider network configured to provide second and third references with respect to the bandgap voltage reference. The temperature compensation circuit is configured to provide a voltage reference configured to at least partially compensate for a temperature sensitivity of a digital microphone system using a sum of (1) the third reference and (2) a difference between the first and second references.

In Example 22, a system or apparatus can include, or can optionally be combined with any portion or combination of any portions of any one or more of Examples 1-21 to include, means for performing any one or more of the functions of Examples 1-21, or a machine-readable medium including instructions that, when performed by a machine, cause the machine to perform any one or more of the functions of Examples 1-21.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A system, comprising:

a temperature compensation circuit for a digital microphone system, the temperature compensation circuit including:

a temperature dependent component configured to provide a first reference with respect to a temperature independent voltage reference; and a voltage divider configured to provide second and third references with respect to the temperature independent voltage reference, wherein the temperature compensation circuit is configured to provide a voltage reference configured to at least partially compensate for a temperature sensitivity of a digital microphone system using the third reference and a difference between the first and second references.

2. The system of claim 1, including:

the temperature independent voltage reference, wherein the temperature independent voltage reference includes a bandgap voltage reference, and wherein the bandgap voltage reference includes a diode.

3. The system of claim 2, wherein the temperature dependent component includes a diode, and wherein the diode of the temperature dependent component matches the diode of the bandgap voltage reference.

4. The system of claim 1, wherein the temperature dependent component includes a diode.

5. The system of claim 1, wherein the digital microphone system includes a temperature sensitive membrane.

6. The system of claim 5, wherein the digital microphone system includes an electret condenser microphone (ECM), the ECM including the temperature sensitive membrane.

7. The system of claim 6, including:

the ECM.

8. The system of claim 1, wherein the digital microphone system includes an electret membrane having a temperature sensitivity, and wherein the temperature compensation circuit is configured to at least partially compensate for the temperature sensitivity of the electret membrane.

9. The system of claim 1, including:

the digital microphone system, the digital microphone system including:

a microphone including a temperature sensitive membrane;

a pre-amplifier configured to receive information from the microphone; and an analog-to-digital converter (ADC) configured to receive information from the pre-amplifier and to receive the reference voltage from the temperature compensation circuit.

10. The system of claim 1, wherein the voltage divider includes a resistor divider network including first, second, and third resistors coupled in series, wherein the first, second, and third resistors have a common temperature coefficient.

11. The system of claim 1, including:

an amplifier configured to receive the first, second, and third references and to provide the voltage reference using a sum of:

(1) the third reference, and (2) a difference between the first and second references.

12. A method, comprising:

providing a first reference, using a temperature dependent component, with respect to a temperature independent voltage reference;

providing second and third references, using a voltage divider, with respect to the temperature independent voltage reference;

providing a voltage reference using a temperature compensation circuit as a function of the third reference and a difference between the first and second references; and at least partially compensating for a temperature sensitivity of a digital microphone system using the voltage reference.

13. The method of claim 12, including:

providing the temperature independent voltage reference using a bandgap voltage reference, the bandgap voltage reference including a diode.

14. The method of claim 13, wherein the temperature dependent component includes a diode, and wherein the diode of the temperature dependent component matches the diode of the bandgap voltage reference.

15. The method of claim 12, wherein the temperature dependent component includes a diode.

16. The method of claim 12, wherein the digital microphone system includes a temperature sensitive membrane.

17. The method of claim 16, wherein the digital microphone system includes an electret condenser microphone (ECM), the ECM including the temperature sensitive membrane.

18. The method of claim 12, wherein the digital microphone system includes an electret membrane having a temperature sensitivity, and wherein the at least partially compensating for the temperature sensitivity includes at least partially compensating for the temperature sensitivity of the electret membrane.

19. The method of claim 12, wherein the voltage divider includes a resistor divider network including first, second, and third resistors coupled in series, wherein the first, second, and third resistors have a common temperature coefficient.

20. The method of claim 12, wherein the providing the voltage reference includes receiving the first, second, and third references using an amplifier and providing the voltage reference using a sum of:

(1) the third reference, and (2) a difference between the first and second references.

21. A system, comprising:

a bandgap voltage reference including a diode; and a temperature compensation circuit for a digital microphone system including an electret condenser microphone (ECM), the temperature compensation circuit including:

a diode configured to provide a first reference with respect to the bandgap voltage reference; and a resistor divider network including first, second, and third resistors coupled in series, the resistor divider network configured to provide second and third references with respect to the bandgap voltage reference;

wherein the temperature compensation circuit is configured to provide a voltage reference configured to at least partially compensate for a temperature sensitivity of a digital microphone system using a sum of:

(1) the third reference, and (2) a difference between the first and second references, and wherein the diode of the bandgap voltage reference matches the diode of the temperature compensation circuit.

* * * * *